US007662000B2

(12) United States Patent
Hou et al.

(10) Patent No.: US 7,662,000 B2
(45) Date of Patent: Feb. 16, 2010

(54) ELECTRIC CONNECTOR

(75) Inventors: Pin-Yuan Hou, Hsin-Tien (TW); Liang-Chun Yeh, Hsin-Tien (TW); Hui Wang, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 28 days.

(21) Appl. No.: 12/170,089

(22) Filed: Jul. 9, 2008

(65) Prior Publication Data

US 2009/0023347 A1 Jan. 22, 2009

(30) Foreign Application Priority Data

Jul. 20, 2007 (TW) ..... 96211898 U

(51) Int. Cl.
*H01R 13/24* (2006.01)

(52) U.S. Cl. ..... 439/824; 439/700

(58) Field of Classification Search ..... 439/824, 439/700, 219, 482

See application file for complete search history.

(56) References Cited

U.S. PATENT DOCUMENTS

| | | | | |
|---|---|---|---|---|
| 6,935,906 | B2 | 8/2005 | Orihara | |
| 7,077,709 | B1 * | 7/2006 | Shin-Ting | 439/700 |
| 7,217,142 | B1 * | 5/2007 | Wu | 439/79 |
| 7,435,109 | B1 * | 10/2008 | Sugiura | 439/83 |
| 2005/0026510 | A1 * | 2/2005 | Orihara | 439/700 |

* cited by examiner

*Primary Examiner*—Hien Vu
(74) *Attorney, Agent, or Firm*—patenttm.us

(57) ABSTRACT

An electric connector has an insulative housing, a plurality of probe contacts and a plurality of terminals. The insulative housing has a plurality of mounting holes and a plurality of mounting slots. The mounting slots communicate respectively with and are perpendicularly to the mounting slots. The probe contacts are mounted respectively in the mounting holes. The terminals are mounted respectively in the mounting slots and respectively hold the probe contacts and each terminal has a fastening portion. The fastening portion is perpendicularly to and securely holds one probe contact. The terminal with the fastening portion is mounted perpendicularly on the probe contact instead of sliding longitudinally along the tubular body. Therefore, the terminal would not wear the probe contact.

9 Claims, 10 Drawing Sheets

ELECTRIC CONNECTOR

BACKGROUND OF THE INVENTION

1. Field of the Invention

The present invention relates to a connector, and more particularly to an electric connector that is durable and has an excellent electrical conductivity and a desirable production rate.

2. Description of Related Art

U.S. Pat. No. 6,935,906 discloses a conventional electric connector having an insulative housing, a plurality of probe contacts and a plurality of terminals. The probe contacts are mounted in the insulative housing in an inclined arrangement and each probe contact has a rear portion and a plating such as gold. The rear portion has a rear end. The terminals are mounted in the insulative housing, are inclined relative to the probe contacts and respectively hold the probe contacts. Each terminal has a ring mounted around the rear portion of one probe contact. When the electric connector is assembled, the ring slides longitudinally onto the rear portion from the rear end of the probe contact.

However, the terminal with the ring is structurally complicated so that manufacturing the terminal is difficult and time-consuming. Furthermore, the inclined arrangement of the probe contacts increases the difficulty to fabricate the electric connector. Moreover, sliding the ring of the terminal onto the rear portion of the probe contact during the assembly of the electric connector easily wears the plating and reduces the electrical conductivity of the probe contact. Therefore, the production rate and the quality of the conventional electric connector are poor and disappointing.

To overcome the shortcomings, the present invention provides an electric connector to mitigate or obviate the aforementioned problems.

SUMMARY OF THE INVENTION

The main objective of the invention is to provide an electric connector that is durable and has an excellent electrical conductivity and a desirable production rate.

An electric connector in accordance with the present invention comprises an insulative housing, a plurality of probe contacts and a plurality of terminals. The insulative housing has a plurality of mounting holes and a plurality of mounting slots. The mounting slots communicate respectively with and are perpendicularly to the mounting slots. The probe contacts are mounted respectively in the mounting holes. The terminals are mounted respectively in the mounting slots and respectively hold the probe contacts and each terminal has a fastening portion. The fastening portion is perpendicularly to and securely holds one probe contact. The terminal with the fastening portion is mounted perpendicularly on the probe contact instead of sliding longitudinally along the tubular body. Therefore, the terminal would not wear the probe contact.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
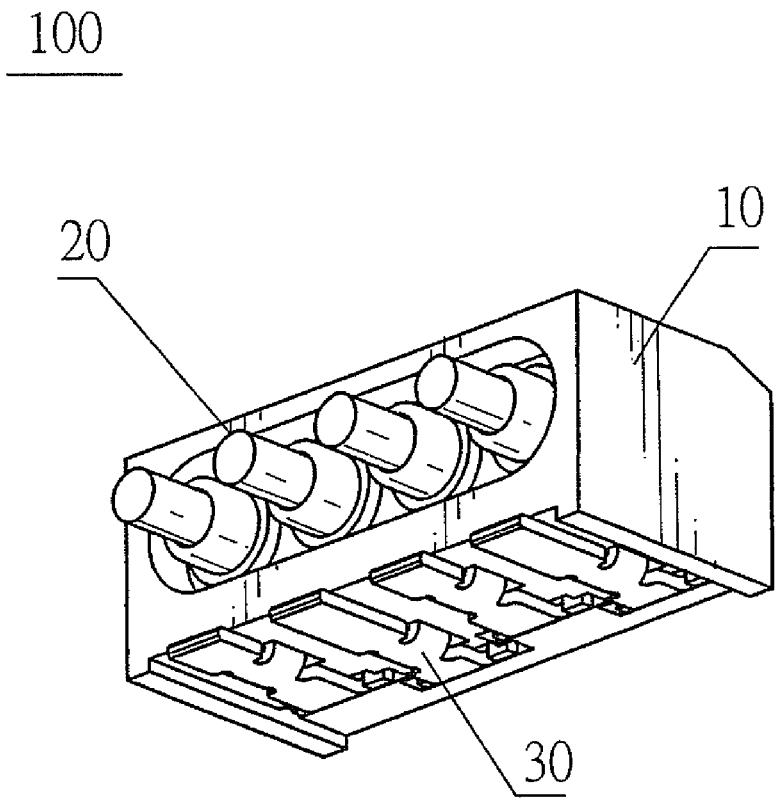
FIG. 1 is a perspective view of an electrical connector in accordance with the present invention.
Figure 2:
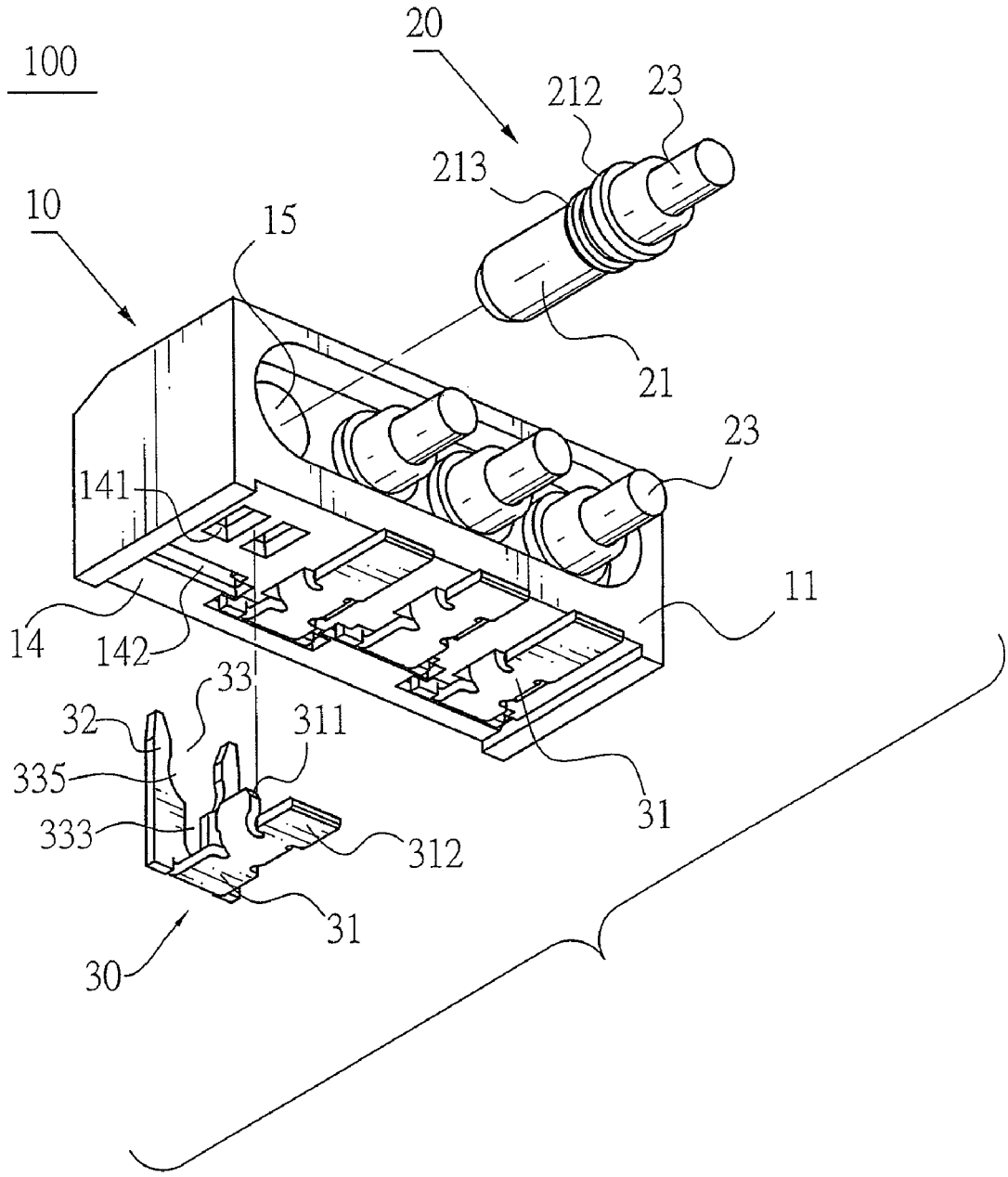
FIG. 2 is a partially exploded perspective of the electric connector in FIG. 1.

With reference to FIGS. 1 and 2, an electric connector (100) in accordance with the present invention comprises an insulative housing (10), a plurality of probe contacts (20) and a plurality of terminals (30).

Figure 3:
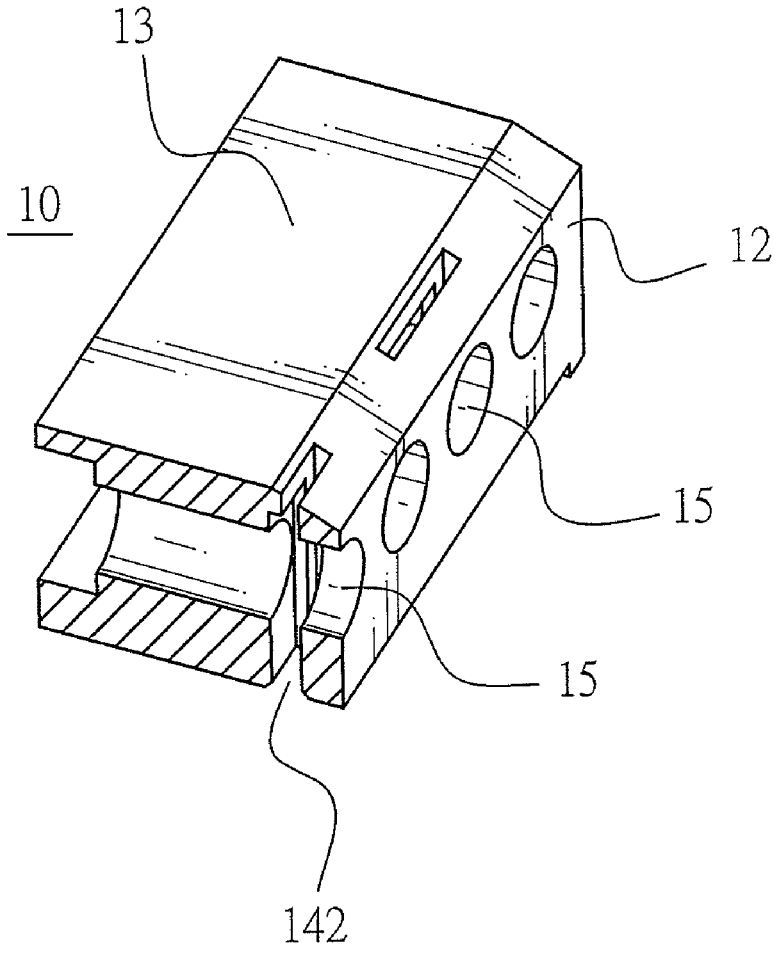
FIG. 3 is a cross sectional perspective view of the insulative housing of the electric connector in FIG. 1.

With further reference to FIG. 3, the insulative housing (10) has a front (11), a rear (13), a bottom (14), a plurality of mounting holes (15) and a plurality of mounting slots (142) and may further have pairs of mounting apertures (141).

The mounting holes (15) are defined longitudinally through the insulative housing (10) from the front (11) to the rear (13) and has a diameter.

The mounting slots (142) are defined in the bottom (14), correspond respectively to and communicate respectively with the mounting holes (15) and are perpendicularly to the mounting holes (15).

The pairs of the mounting apertures (141) correspond respectively to the mounting slots (142) and are defined in the bottom (14).

Figure 4:
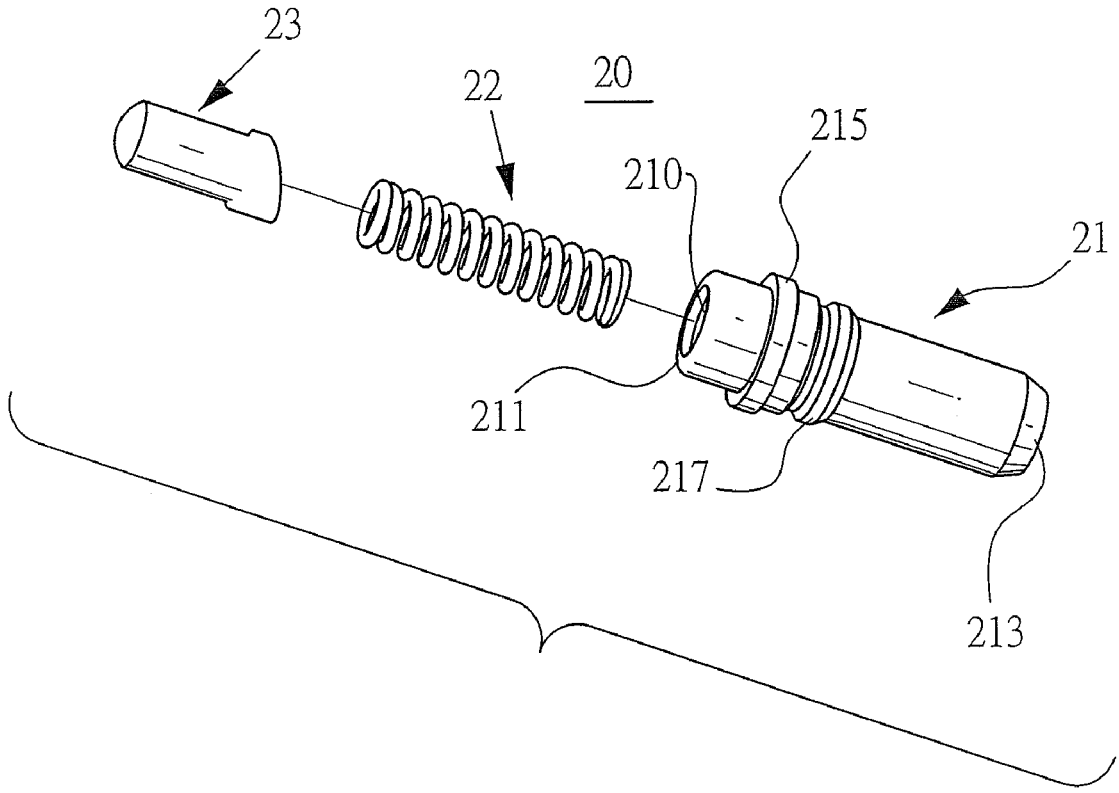
FIG. 4 is an exploded perspective view of the probe contact of the electric connector in FIG. 1.

With further reference to FIG. 4, the probe contacts (20) may be plated with a plating such as gold for improving conductivity, correspond respectively to and are mounted respectively in the mounting holes (15), correspond respectively to the mounting slots (142) and each probe contact (20) has a tubular body (21), a probe (23) and a spring (22).

The tubular body (21) is hollow, is made of metal, is mounted securely in a corresponding mounting hole (15) and has a closed end (213), an open end (211), a chamber (210), an outer annular flange (215) and an inner annular flange (217). The chamber (210) is defined longitudinally in the tubular body (21) and communicates with the open end (211). The closed end (211) is mounted in the corresponding mounting hole (15). The open end (211) is opposite to the closed end (213) and extends out of the corresponding mounting hole (15). The outer annular flange (215) is formed on and protrudes radially from the tubular body (21), abuts against the front (11) of the insulative housing (10) and has a diameter larger than that of the mounting hole (15). The inner annular flange (217) is formed on and protrudes radially from the tubular body (21), is mounted in a corresponding mounting slot (142) and has a diameter larger than that of the mounting hole (15).

The probe (23) is made of metal, is mounted slidably in the chamber (210) and extends out of the open end (211) of the tubular body (21), may contact a terminal of a power or signal transmission cable and has an inside end.

The spring (22) is mounted in the chamber (210), presses against the inside end of the probe (23) to bias the probe (23) out of the open end (210) of the tubular body (21).

Figure 5A:
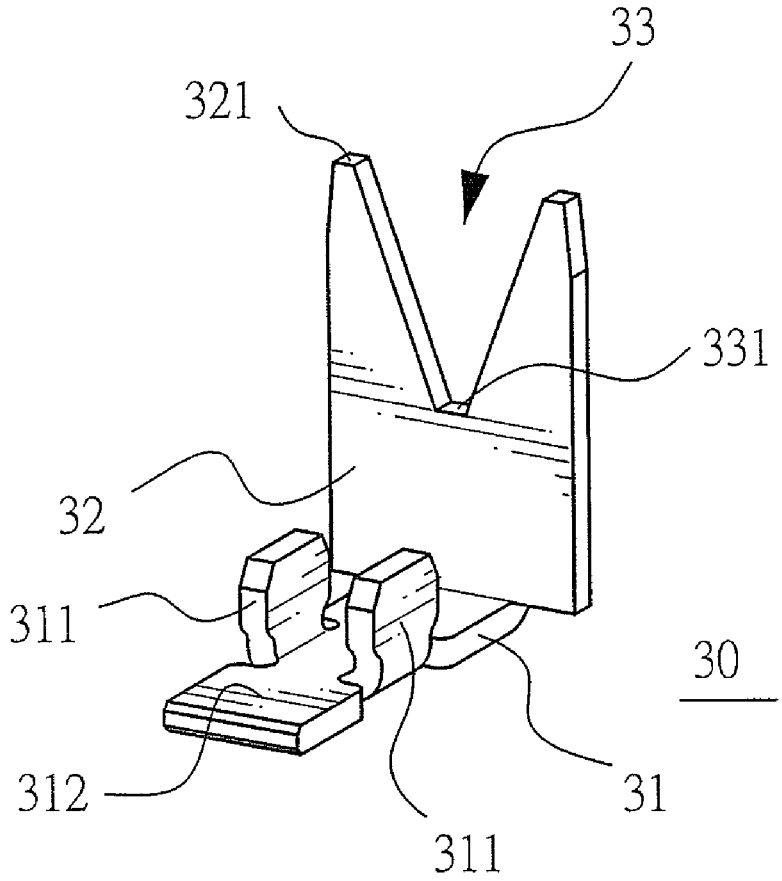
FIG. 5A is a perspective view of a first variant of the terminal of the electric connector in FIG. 1.
Figure 5B:
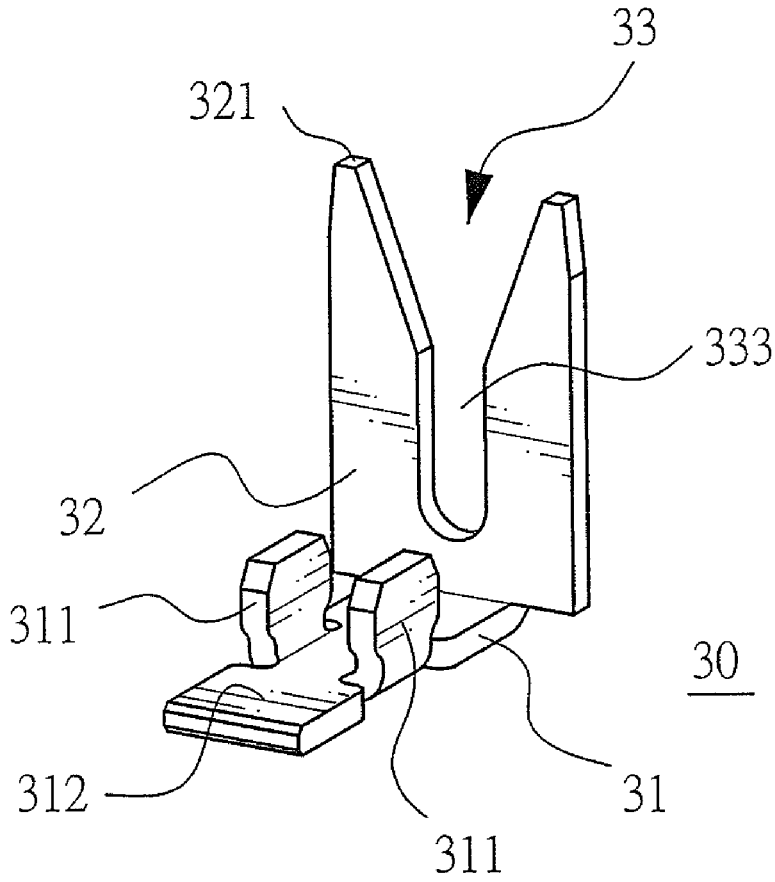
FIG. 5B is a perspective view of the first variant of the terminal of the electric connector in FIG. 5A further having a slit.
Figure 5C:
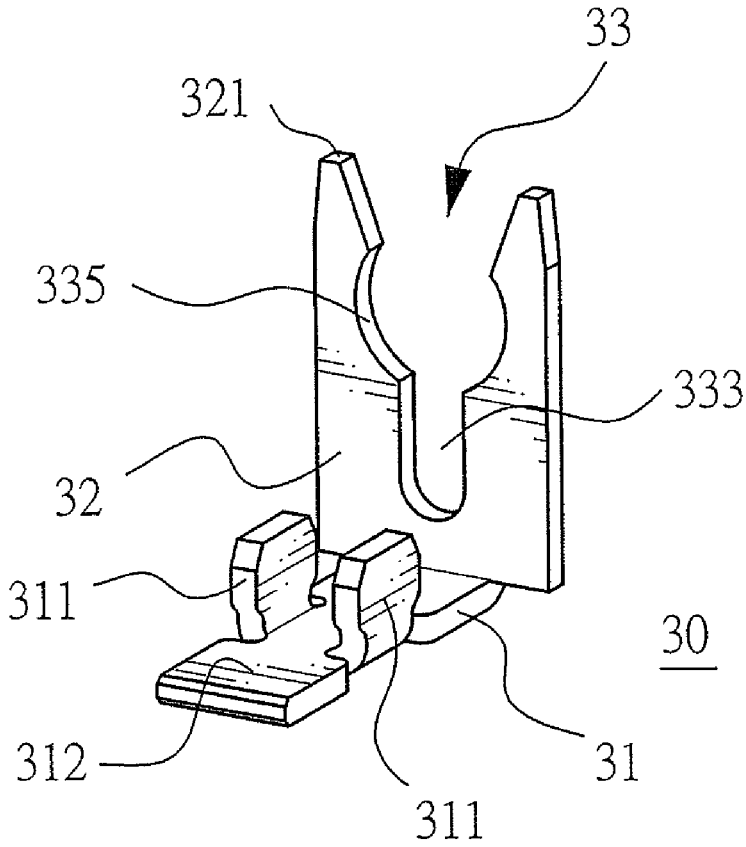
FIG. 5C is a perspective view of the first variant of the terminal of the electric connector in FIG. 5A further having a slit and a pair of cutouts.
Figure 6A:
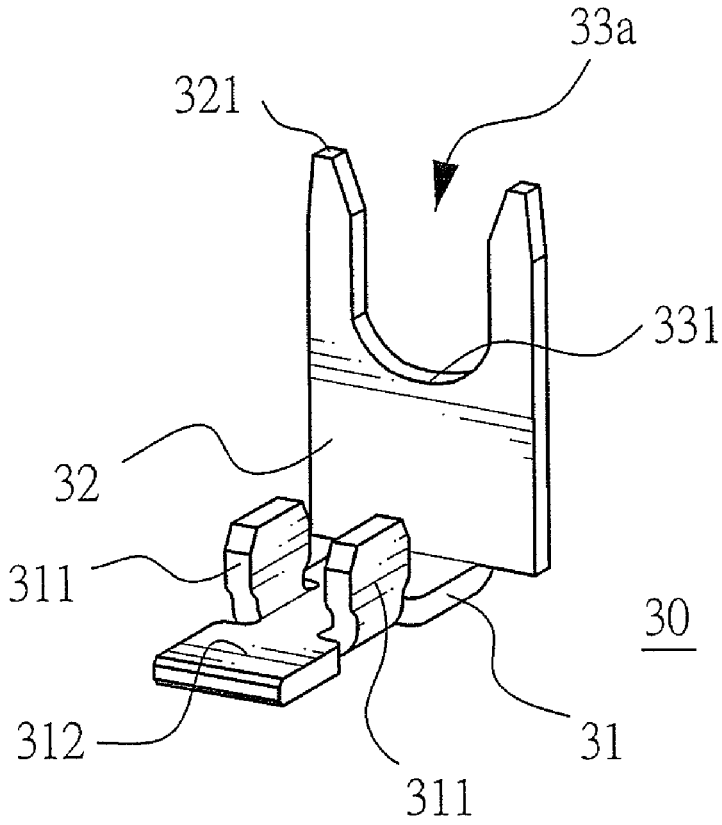
FIG. 6A is a perspective view of a second variant of the terminal of the electric connector in FIG. 1.
Figure 6B:
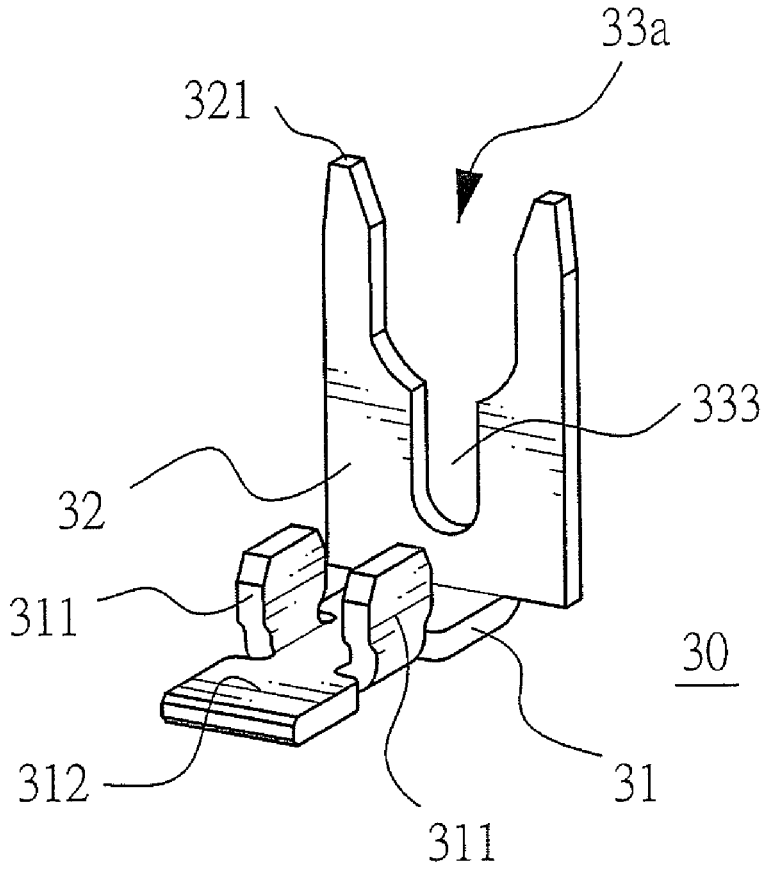
FIG. 6B is a perspective view of the second variant of the terminal of the electric connector in FIG. 6A further having a slit.
Figure 6C:
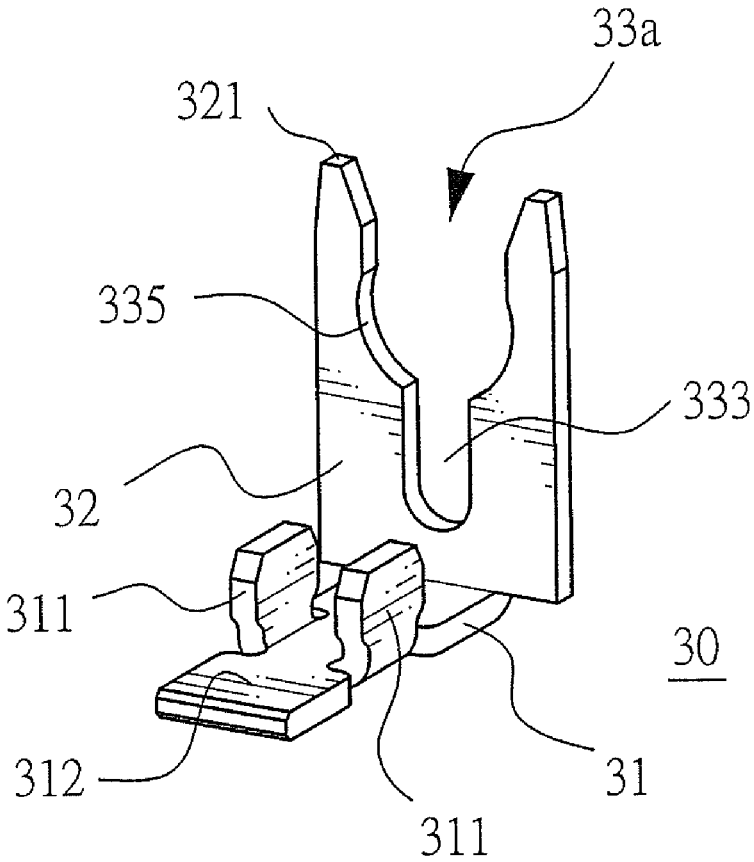
FIG. 6C is a perspective view of the second variant of the terminal of the electric connector in FIG. 6A further having a slit and a pair of cutouts.

With further reference to FIGS. 5A and 6A, the terminals (30) are L-shaped, correspond respectively to and are mounted respectively in the mounting slots (142) in the insulative housing (10) and correspond respectively to and respectively hold the probe contacts (20). Each terminal (30) has a body portion (31), a fastening portion (32) and a soldering portion (312) and may further has a pair of mounting tabs (141).

The body portion (31) abuts against the bottom (14) of the insulative housing (10) and has two opposite sides.

The fastening portion (32) is forked, is formed on and protrudes perpendicularly from the body portion (31), is mounted in a corresponding mounting slot (142) of the insulative housing (10) and is perpendicularly to and transversely holds the tubular body (21) of a corresponding probe contact (20) in the insulative housing (10). The fastening portion (32) has a distal end (321), two prongs, a notch (33, 33*a*) and may further have a slit (333) and a pair of cutouts (335), as shown in FIGS. 5B, 6B, 5C and 6C. The prongs extend in the corresponding mounting slot (142) of the insulative housing (10), are located between the outer annular flange (215) and inner annular flange (217) and abut against the inner flange (217) of the corresponding probe contact (20) to prevent the tubular body (21) from inadvertently falling out of the mounting slot (15). The notch (33, 33*a*) may be V-shaped or U-shaped, is defined in the distal end (321) between the prongs, transversely clamps the tubular body (21) and has an inner bottom surface (331). The slit (333) is defined longitudinally in the inner bottom surface (331) of the notch (33, 33*a*) and further splits the fastening portion (32) to have sufficient resilience to prevent the fastening portion (32) from tearing when engaged with the probe contact (20). The cutouts (335) are curved, are defined respectively in the prongs in the notch (33, 33*a*) and tightly contact the tubular body (21) of the corresponding probe contact (20) to prevent the tubular body (21) from inadvertently falling out of the notch (33, 33*a*) of the terminal (30).

The soldering portion (312) is formed on and protrudes from the body portion (31) opposite to the fastening portion (32) and may be mounted on a printed circuit board.

The mounting tabs (311) are formed on and perpendicularly protrude respectively from the sides of the body portion (31) and are mounted respectively in the mounting apertures (141) of one pair of the insulative housing (10) to prevent the terminal (30) from swaying.

When the electric connector is assembled, the terminal (30) with the fastening portion (33) is mounted transversely and perpendicularly on the tubular body (21) of the corresponding probe contact (20) instead of sliding longitudinally along the tubular body (21). Therefore, the plating on the tubular body (21) would not be worn by the terminal (30) and the electric connector (100) is durable and has an excellent electrical conductivity. Furthermore, the mounting slots (142) are perpendicularly to the mounting holes (15) to allow the fastening portion (32) of the terminal (30) to be mounted perpendicularly on the tubular body (21) of the probe contact (20) instead of being inclined relative to the probe contact (20). Therefore, assembling the electric connector is easy and convenient. The production rate of the electric connector is desirable.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electric connector comprising:

an insulative housing having a front;

a rear;

a bottom;

a plurality of mounting holes defined through the insulative housing from the front to the rear; and a plurality of mounting slots defined in the bottom, corresponding respectively to and communicating respectively with the mounting holes and being perpendicularly to the mounting holes;

a plurality of probe contacts corresponding respectively and mounted respectively in the mounting holes, corresponding respectively to the mounting holes and each probe contacts having a tubular body made of metal, mounted securely in a corresponding mounting hole and having a closed end;

an open end; and a chamber defined in the tubular body and communicating with the open end;

a probe made of metal, mounted slidably in the chamber and extending out of the open end of the tubular body; and a spring mounted in the chamber and biasing the probe out of the open end of the tubular body; and a plurality of L-shaped terminals corresponding respectively to and mounted respectively in the mounting slots in the insulative housing, corresponding respectively and respectively holding the probe contacts and each terminal having a body portion having two opposite sides;

a fastening portion formed on and protruding perpendicularly from the body portion, mounted in a corresponding mounting slot of the insulative housing, being perpendicularly to and transversely holding the tubular body of a corresponding probe contact in the insulative housing and having a distal end;

two prongs extending in the corresponding mounting slot; and a notch defined in the distal end between the prongs, transversely clamping the tubular body and having an inner bottom surface; and a soldering portion formed on and protruding from the body portion opposite to the fastening portion;

wherein the tubular body further has an outer annular flange formed on and protruding radially from the tubular body and abutting against the front of the insulative housing.

2. The electric connector as claimed in claim 1, wherein the outer annular flange of the tubular body of each probe contact has a diameter larger than that of each mounting hole of the insulative housing.

3. The electric connector as claimed in claim 2, wherein:

the tubular body further has an inner annular flange formed on and protruding radially from the tubular body and mounted in a corresponding mounting slot; and the prongs of the fastening portion of each terminal is between the outer flange and inner flange and abuts against the inner annular flange of the corresponding probe contact.

4. The electric connector as claimed in claim 3, wherein the inner annular flange of the tubular body of each probe contact has a diameter larger than that of each mounting hole of the insulative housing.

5. The electric connector as claimed in claim 4, wherein the fastening portion of each terminal further has a slit defined longitudinally in the inner bottom surface of the notch.

6. The electric connector as claimed in claim 5, wherein the fastening portion of each terminal further has a pair of cutouts defined respectively in the prongs in the notch and tightly contacting the tubular body of the corresponding probe contact.

7. The electric connector as claimed in claim 6, wherein:

the insulative housing further has pairs of mounting apertures defined in the bottom; and each terminal further has a pair of mounting tabs formed on and perpendicularly protruding respectively from the sides of the body portion of the terminal and mounted respectively in the mounting apertures of one pair of the insulative housing.

8. The electric connector as claimed in claim 7, wherein the notch of the fastening portion of each terminal is V-shaped.

9. The electric connector as claimed in claim 7, wherein the notch of the fastening portion of each terminal is U-shaped.

* * * * *